US006447203B1

(12) United States Patent
Ruiz et al.

(10) Patent No.: US 6,447,203 B1
(45) Date of Patent: Sep. 10, 2002

(54) LOAD TRANSFER DOWEL SUPPORT

(75) Inventors: Hector G. Ruiz, Dallas, TX (US); John E. Wachtendorf, Cedar Hill, TX (US)

(73) Assignee: Meadow-Burke Products, Tampa, FL (US)

( * ) Notice: Subject to any disclaimer, the term of this patent is extended or adjusted under 35 U.S.C. 154(b) by 0 days.

(21) Appl. No.: 09/654,954

(22) Filed: Sep. 5, 2000

(51) Int. Cl.[7] ..... E01C 11/16

(52) U.S. Cl. ..... 404/70; 404/134; 404/135; 404/136; 52/677

(58) Field of Search ..... 404/134, 135, 404/136, 53, 56, 62, 70, 47, 71; 52/677, 679, 682, 684, 685, 686

(56) References Cited

U.S. PATENT DOCUMENTS

| | | | | | |
|---|---|---|---|---|---|
| 2,552,365 | A | * | 5/1951 | Bradbury | 404/62 |
| RE24,172 | E | * | 6/1956 | Brickman | 404/63 |
| 2,783,695 | A | * | 3/1957 | de Canio | 404/62 |
| 2,829,572 | A | * | 4/1958 | Vanek | 404/62 |
| 3,288,039 | A | | 11/1966 | Crone | 94/8 |
| 4,644,726 | A | | 2/1987 | Wheeler | 52/677 |
| 4,648,739 | A | * | 3/1987 | Thomsen | 404/2 |
| 4,800,702 | A | | 1/1989 | Wheeler | 52/677 |
| 4,883,385 | A | | 11/1989 | Kaler | 404/47 |
| 5,216,866 | A | | 6/1993 | Ekedal | 52/677 |
| 5,678,952 | A | | 10/1997 | Shaw et al. | 404/62 |
| 5,791,816 | A | * | 8/1998 | McCallion | 404/136 |
| 5,878,546 | A | | 3/1999 | Westover | 52/719 |
| 5,893,252 | A | * | 4/1999 | Hardy, Jr. et al. | 52/685 |
| 6,019,546 | A | | 2/2000 | Ruiz | 404/134 |
| 6,092,960 | A | * | 7/2000 | McCallion | 404/70 |
| 6,210,070 | B1 | * | 4/2001 | Shaw et al. | 404/70 |

* cited by examiner

*Primary Examiner*—Gary S. Hartmann
(74) *Attorney, Agent, or Firm*—Pettis & Van Royen, P.A.

(57) ABSTRACT

The invention relates to supports for apparatus for transferring weight loads from one concrete structure to another. The devices are particularly suited for concrete highway construction. The support apparatus is used to position joint dowels that extend across paving joints between adjoining concrete slabs. The support apparatus comprises a first and a second support, each positioned on opposing sides of the paving joint. Each of the first and second supports comprise at least one longitudinally extending member having at least two cross members attached thereto such that one end of the cross member extends outwardly beyond the member. At least one clip comprising a body having a cavity therein, a gripper connected to the body and a cylindrical sleeve connected to the body is attached to each support. The clip is mounted to the end of a cross member so that the first end of the cross member is received into the cavity of the body and the attached gripper grasps the adjacent portion of the member. The sleeves are sized and configured to receive a dowel therein. When the first and second supports are spaced apart a predetermined distance from one another on opposing sides of a construction joint and opposing sleeves are aligned with one another, the first end of a dowel is receivable in one sleeve and the second end of the dowel is receivable in the opposing sleeve.

6 Claims, 4 Drawing Sheets

48
46
58
50
52
54
38
42
18
30
16
44
D
28
34
7
32
56

LOAD TRANSFER DOWEL SUPPORT

BACKGROUND OF THE INVENTION

1. Field of the Invention

The present invention relates to a support apparatus for transferring moving loads from one concrete structure to an adjacent concrete structure. The device being particularly relevant for maintaining the spatial relationship between adjoining concrete paving slabs that are spaced apart by a paving joint.

2. Description of the Prior Art

The use of dowel joints to tie adjoining paving slabs is well-known in the art. These dowels are positioned within the concrete formwork, when formwork is used, prior to pouring the concrete so that the dowels extend through the paving joints and are encased in both of the adjoining paving slabs. When slip form paving equipment is being used, the dowels are positioned on the sub grade spaced inwardly from the future longitudinal edge of the slab. The dowels prevent vertical movement between the adjoining slabs at a paving joint so that the load moving from one of the slabs is smoothly transferred to the adjacent slab. There are many different types of concrete paving joints that use load transfer devices. The most prevalent are transverse contraction joints, formed to compensate for the shrinkage that occurs in freshly poured concrete. Other paving joints include transverse and longitudinal expansion joints, transverse and longitudinal construction joints and longitudinal contraction joints.

Various devices exist that support and hold the dowels in the proper position during the pour of the concrete slab. For example U.S. Pat. No. 2,768,562, issued to William S. Godwin discloses a rather complex arrangement of supports that requires a large amount of labor for field assembly, including attachment of the supports to the sides of the forms. The dowels are maintained longitudinally by a pair of baskets that are formed by welding, and then are fitted to a support frame.

In U.S. Pat. No. 5,678,952, issued to Shaw et al., a hollow tube is attached to temperature wire adjacent to the slab formwork. Upon removal of the formwork, a dowel is inserted in the tube so that it extends across the paving joint into the area in which the next slab is to be poured.

In U.S. Pat. No. 3,397,626 issued to J. B. Kornick et al., the dowels extend between loops formed in opposing frames. To hold the dowels firmly in place they are welded to one of the loops. This welding operation must be accomplished at the plant where the wire frames are constructed or must be welded in the field, increasing the costs.

U.S. Pat. No. 6,019,546 issued to Ruiz, discloses a pair of opposing wire supports that have loops and cradles alternately formed therein. To attach the dowels to the wire supports, a key, having a widened center portion, must be inserted between the cradle and the dowel.

Since it is desirable that the dowels be held firmly in place during a concrete pour, many support systems require that the dowels be tack welded to a support frame before it is delivered to the construction site. Such requirements increase the assembly and transportation cost, as the frames with the tack welded dowels attached are bulky and awkward to ship. This method of assembly has reduced the labor in the field but has increased the fabrication and shipping costs. Therefore, what is needed is an apparatus where the dowels may be easily maintained in the proper position with little labor involvement.

It has been pointed out that the prior art is either so complex that it is expensive to make, or it requires welding and thereby increases the labor costs and frequently the transportation costs. Therefore, it remains clear that there is a need for a device to support load transfer dowels that is simple to manufacture, easily stacked for transportation and easily installed in the field, providing a simple and sufficiently tight connection without welding.

SUMMARY OF THE INVENTION

The present invention comprises a support apparatus for placing a load transfer dowel within a concrete construction. The present apparatus is inexpensive to manufacture, easy to transport and easy to install in the field. The apparatus is particularly suited for highway construction, and for clarity the discussion in the specification concerning method of use will be directed primarily to highway construction. However, the support apparatus may be used in the assembly of other concrete structures that require dowels or reinforcing bars to join adjacent concrete structures.

There are many different types of concrete paving joints that use load transfer devices. The most prevalent are transverse contraction joints, formed to compensate for the shrinkage that occurs in freshly poured concrete. Other paving joints include transverse and longitudinal expansion joints, transverse and longitudinal construction joints and longitudinal contraction joints.

Most simply stated, the apparatus comprises first and second supports that are positioned on a roadbed subgrade so they are spaced apart from one another and are situated on opposing sides of the concrete paving joint separating the adjacent slabs. One of the supports extends between the planned longitudinal edges of one of the adjoining slabs, and the other support extends between the planned longitudinal edges of the other slab. The first and second supports position the dowels so that when they are inserted within the supports they extend across the paving joint at a predetermined height above the subgrade, at predetermined intervals, and generally parallel to longitudinal edges of the concrete pavement.

Each support comprises at least one member that extends longitudinally the full-length of the support. At least two cross members are attached to the member, with one cross member attached at each location that has been predetermined for placement of a dowel. As there are normally a plurality of dowels to be placed across a paving joint, there are normally a plurality of cross members attached to the member. These cross members are spaced in accordance with the predetermined spacing of the dowels. Each cross member has a first end and a second end and the cross members are attached to the member at a point that is proximal to the first end of each cross member with a predetermined portion of the cross members extending outwardly from the member a predetermined length.

Each support also comprises at least one clip, which is attached to the member. The clip comprises a body which has an opening through its outer surface into a cavity. The opening and the cavity of the body are sized and configured to receive the first end of one of the cross members therein. A gripper is connected to the body so that the gripper can grasp the member, thereby attaching the clip to the member. A cylindrical sleeve, having a closed first end and an open second end, is attached to the body so that a longitudinal axis passing through the sleeve is generally normal to the member. When the first and second supports are positioned on the subgrade, they are spaced apart a predetermined distance from one another and they are aligned so that the longitudinal axes of the opposing sleeves are generally coincident. The first end of a dowel may now be received in one sleeve and the second end of that dowel may be received by the opposing sleeve.

The invention accordingly comprises an article of manufacturer possessing the features, properties, and the relation to elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DESCRIPTION OF A PREFERRED EMBODIMENT

Figure 1:
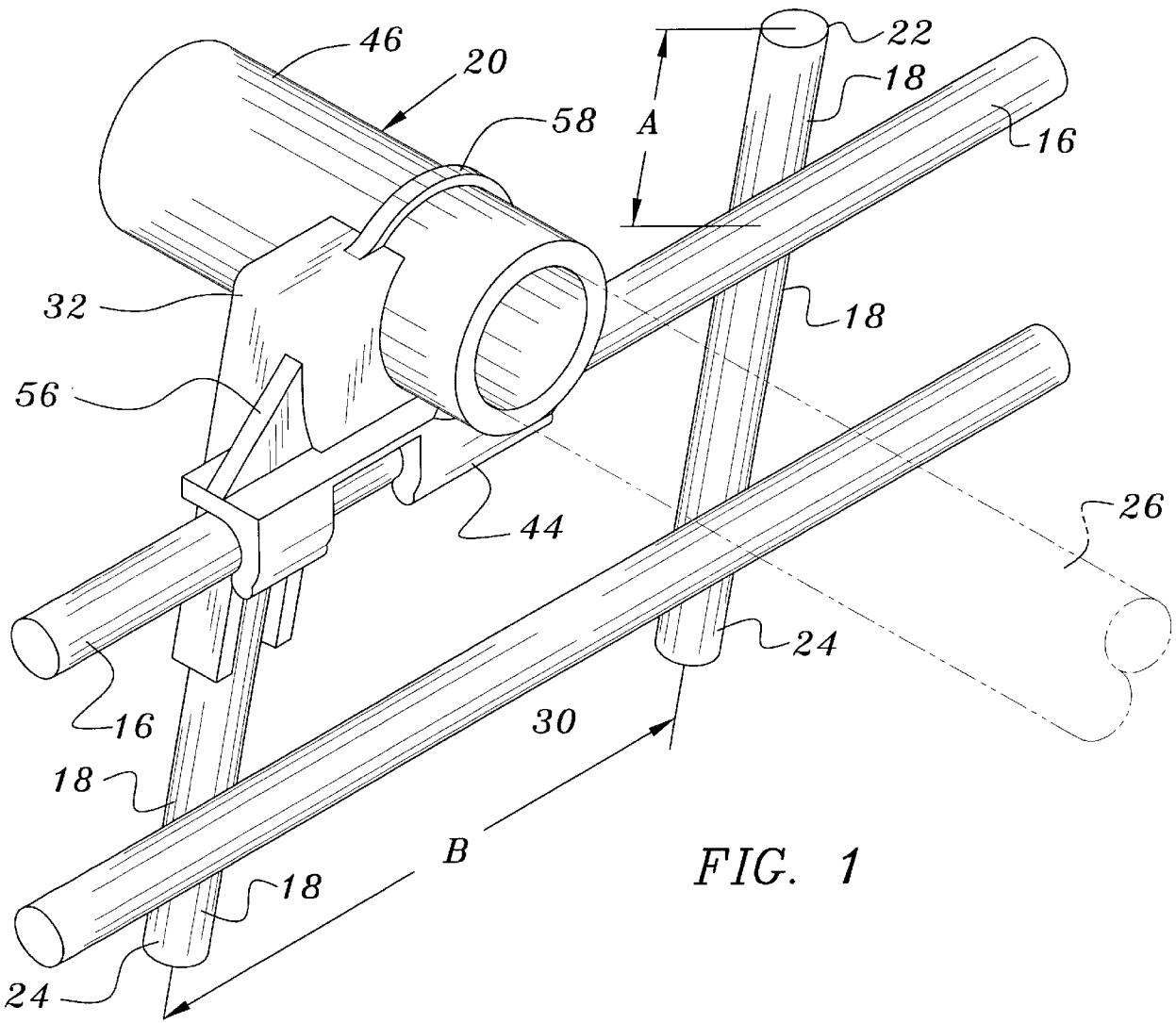
FIG. 1 is an isometric view of one support of the load transfer apparatus, illustrating the insertion of one end of a dowel therein.
Figure 7:
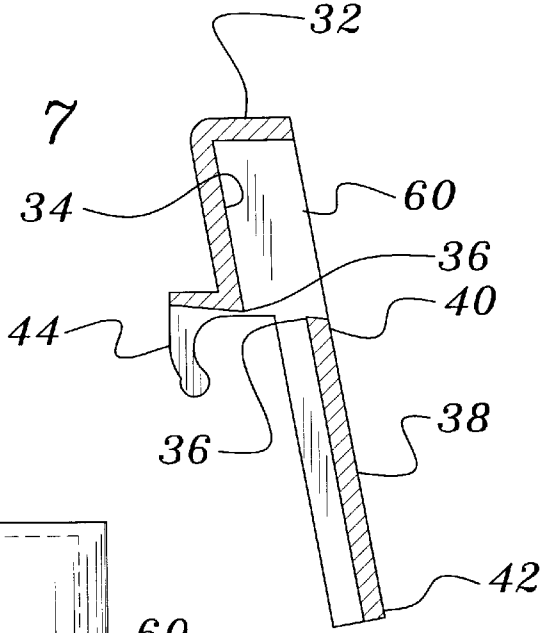
FIG. 7 is a cross-sectional detailed view of the body taken along line 7—7 of FIG. 3.
Figure 6:
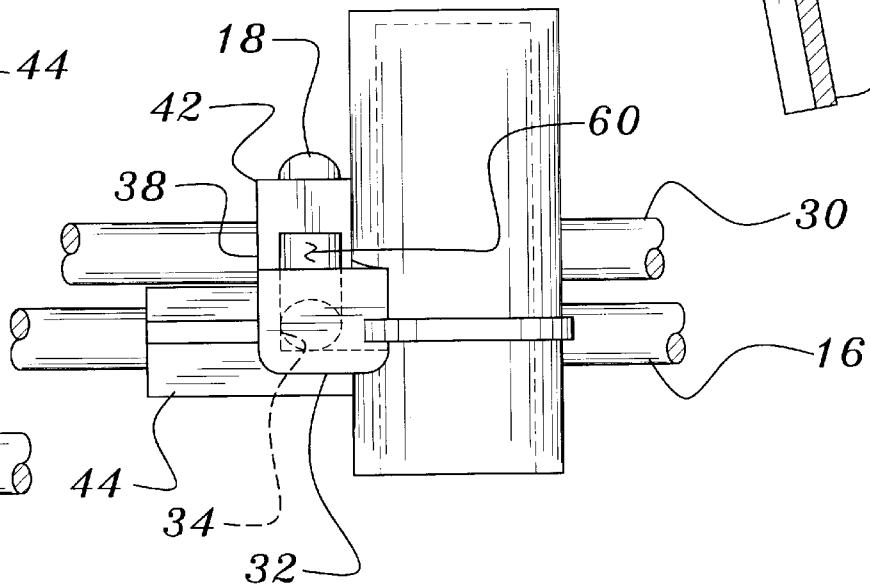
FIG. 6 is a top plan view of the invention of FIG. 1.
Figure 8:
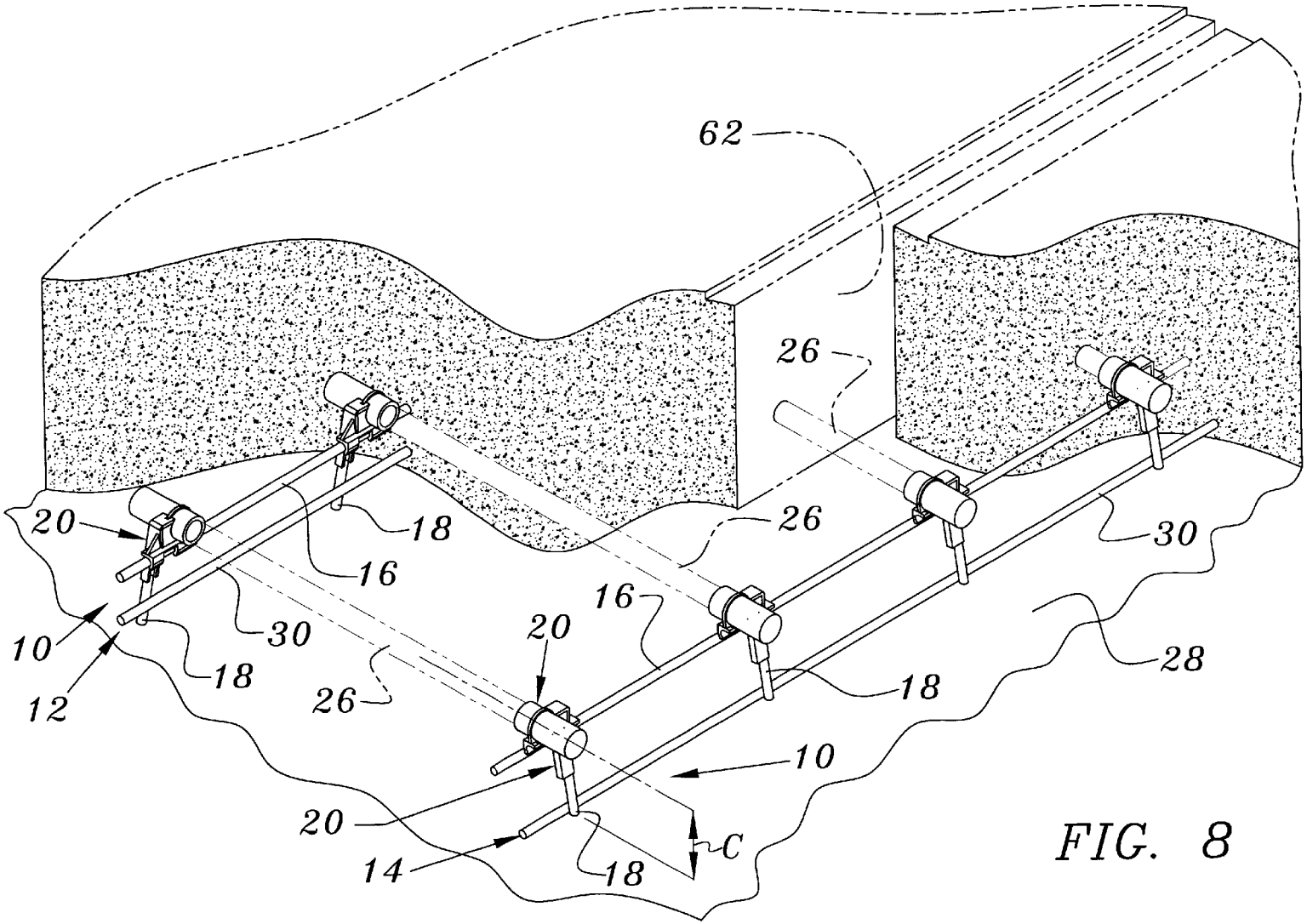
FIG. 8 is an isometric view of a plurality of clips attached to the first and second supports, and illustrating dowels mounted within corresponding clips and illustrating the support apparatus inserted within a slab, the slab being broken away for purposes of illustration.

A preferred embodiment for the apparatus for placement of a load transfer dowel is illustrated in the drawing FIGS. 1–8. The support apparatus for a load transfer dowel is indicated generally as 10 in the drawings. Referring first to FIG. 8, it can be seen that the apparatus 10 comprises a first support 12 and second support 14. Each support comprises at least one generally horizontally extending member 16, at least two cross members 18 and at least one clip 20. Referring next to FIG. 1, it can be seen that each cross member 18 has a first end 22 and a second end 24. Each cross member 18 is attached to the member 16 proximal to the first end 22 of the cross member. The first end 22 extends outwardly from its point of attachment to the member 16 a predetermined distance A, which in a preferred embodiment is approximately ½ inch. The distance B between cross members 18 is determined by two factors: first, the cross members must be placed at least as frequently as the required spacing between the dowels, illustrated in phantom as 26; and second, the cross members 18 must be spaced sufficiently close to one another to provide adequate support for the member 16. As shown in FIG. 8, the second ends 24 of each cross member 18 engage the subgrade 28. The cross members are sized to position the dowels 26 at a predetermined height C above the subgrade 28, which is considered generally to be a plane surface. In a preferred embodiment, as discussed further below, the cross members 18 engage the subgrade 28 at an angle D of approximately 80 degrees. Obviously, this angle will affect the necessary length of the cross members 18 to ensure that the dowels 26 are positioned at the predetermined distance C above the subgrade 28. In a preferred embodiment, as shown in FIG. 8, the first support 12 and the second support 14 each comprise an additional longitudinally extending member 30 to provide additional strength to the supports 12 and 14, creating a pair of longitudinally extending, generally parallel members 16 and 30.

Figures 2, 3, 4:
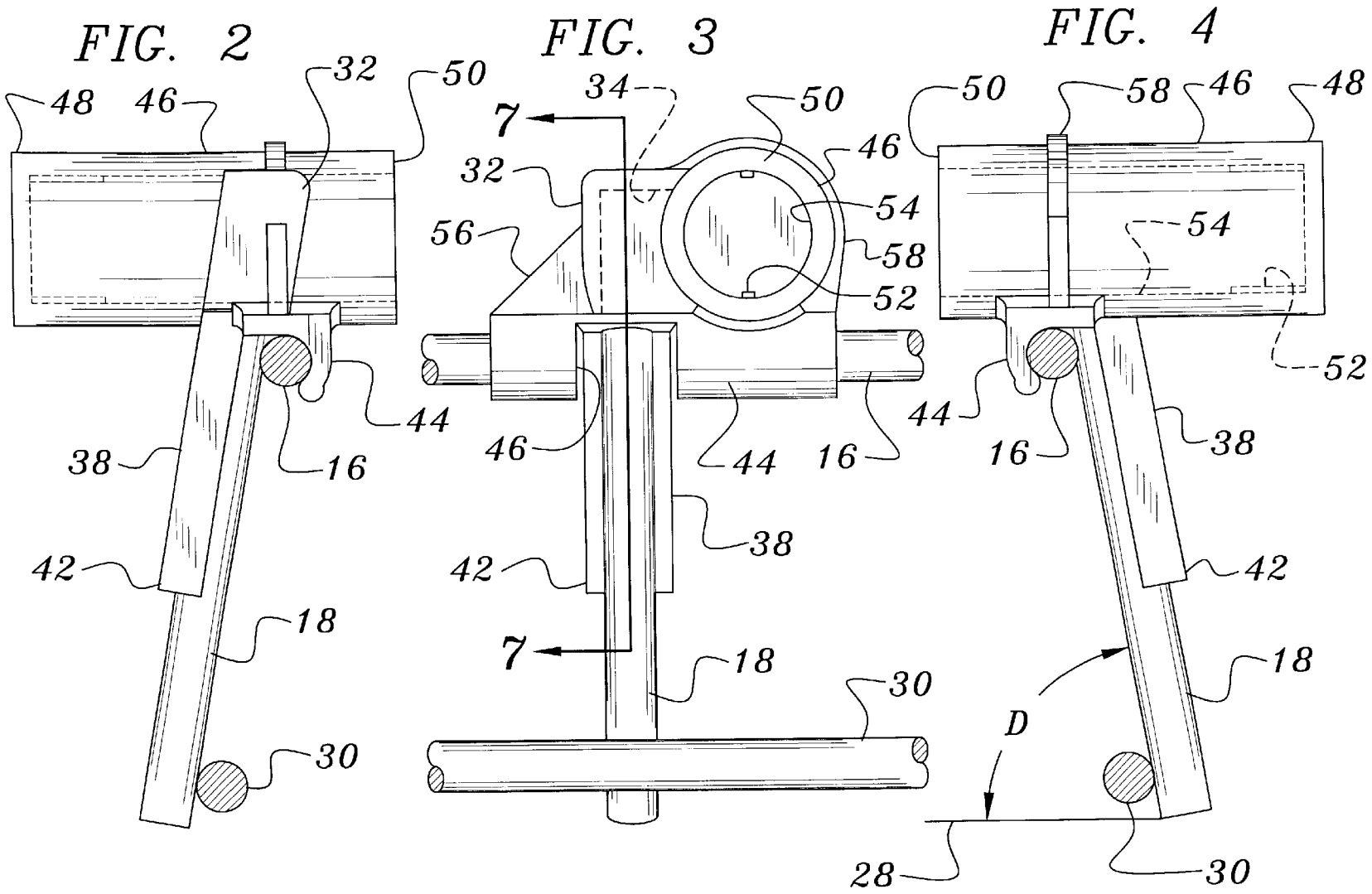
FIG. 2 is a left side elevational view of the invention of FIG. 1.
FIG. 3 is a front elevational view of the invention of FIG. 1.
FIG. 4 is a right side elevational view of the invention of FIG. 1.
Figure 5:
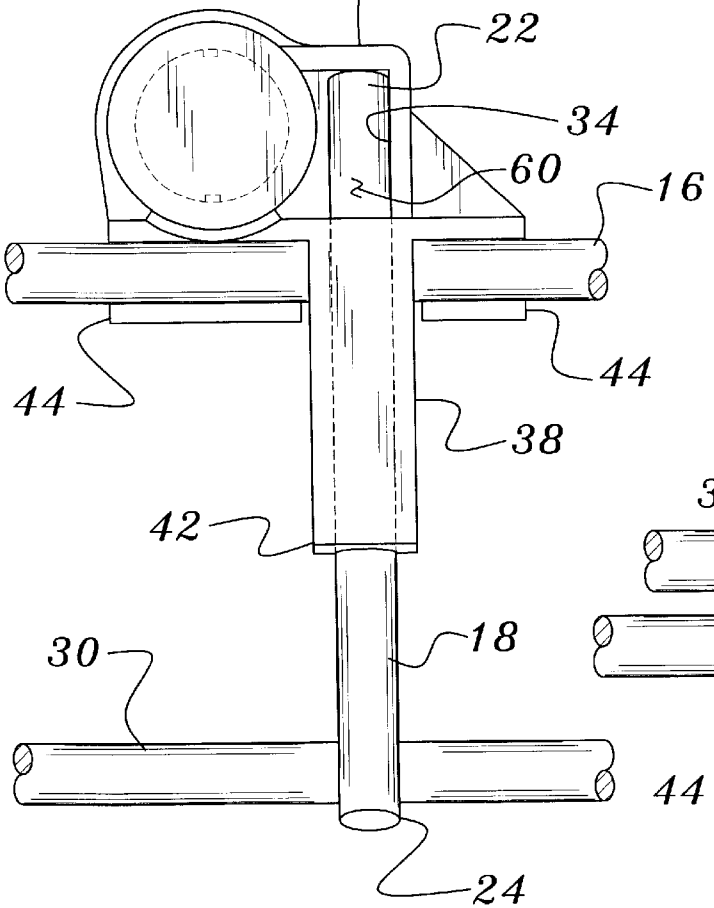
FIG. 5 is a rear elevational view of the invention of FIG. 1.

As shown in FIG. 8, at least one clip 20 is mounted on the first support 12 and at least one clip 20 is mounted on the second support 14. As shown in FIGS. 1–7, clip 20 is comprised of a body 32 that has a cavity 34 formed therein and an opening 36 into the cavity 34, as seen in FIG. 5 and FIG. 7. The cavity 34 and the opening 36 into the cavity 34 is sized and configured to receive therein the first end 22 of the cross member 18. The body further comprises a U-shaped element 38 which has a first end 40 and a second end 42. The first end 40 is attached to the body 32 proximal to the opening 36 and the second end 42 extends outwardly therefrom. The element 38 is sized and configured to receive a portion of the cross member 18 therein when the first end 22 of the cross member 18 is inserted through the opening 36 and into the cavity 34 of the body 32.

A gripper 44 is connected to the body 32 so that the gripper 44 grasps the member 16 attaching the clip 32 to the member 16. The gripper 44 is comprised of a flexible and resilient curved arm, as shown clearly in FIG. 2 and FIG. 4, permitting the gripper 44 to snap around the member 16 clamping the cross member 18 against the element 38 and holding the clip 32 so tightly to the member 16 that the clips 20 will remain attached when the support apparatus 10 is moved into position on the subgrade 28. The gripper 44 has a slot 46, as shown in FIG. 3, to permit easy access of the first end 22 of the cross member 18 into the opening 36 of the cavity 34. The element 38 strengthens the clip 20, so that it resists the twisting moment applied by the downward force received by the apparatus 10 when the concrete is poured over the apparatus 10 during construction.

The clip 20 further comprises a cylindrical sleeve 46 that has a closed first end 48 and an open second end 50 that is connected to the body 32. In a preferred embodiment, the sleeve 46 is attached to both the body 32 and the gripper 44 in order to form a strong clip 20. In other embodiments, the sleeve 46 may be attached only to the body 32 or only to the gripper 44. The sleeve 46 is sized and configured so that a dowel is receivable through said open second end 50 into the sleeve. Adjacent to the closed-end 48 of the sleeve 46 is a least one ridge 52 that is attached to and extends longitudinally along the interior surface 54 of the sleeve 46. This ridge 52 prevents the full insertion of the dowel 26 into the sleeve 46 during placement of the support apparatus 10 on the subgrade 28 in preparation for a concrete pour. This leaves a space at the closed-end of each sleeve 46, permitting the dowel 26 to expand into this space after the support apparatus 10 is encased in concrete. The standard for highway construction is a total of one inch of expansion, which is achieved by providing ridges 52 of ½ inch length in both of the opposing sleeves. These ridges are frangible so that they do not resist the expansion of the dowel 26. Certainly the length of these ridges may be modified to ensure a suitable expansion zone for the particular use planned for the support apparatus 10.

As mentioned previously, and as seen in FIG. 8 and clearly in FIGS. 2 and 4, the body 32 may be attached to the sleeve 46 and the gripper 44 at an angle so that when the sleeves 46 are generally parallel to the subgrade 28, so that the dowels, when inserted in the sleeves 46, will also be parallel to the subgrade 28, the cross members 18 are at an angle D with the subgrade 28. Sometimes it is desirable that the support apparatus 10 be preassembled in a shop rather than at the construction site. The support apparatus 10 is assembled and then the dowels 26 are inserted within the support apparatus 10 to form a completed unit. By attaching the body to the cylinder at an angle D, the completed units may be nested in one another saving space when shipping the completed units from the shop to the construction site, thereby cutting shipping costs.

The particular design of the apparatus 10 illustrated in the drawing FIGS. 1–8, is to permit molding the clip 20 from a synthetic resin as a single unit. Some structure has been added to strengthen the clip 20, in particular the triangular shape 56 and the integrally molded strap 58 that extends about the sleeve 46 and is attached to the body 32. Other structure has been eliminated, creating the aperture 60, shown in FIG. 7. The aperture 60 has no operative significance and is formed only to assist in the molding process. In other embodiments, this aperture 60 may be closed. In a preferred embodiment, the members 16 and 30, arid the cross members 18 are each fabricated from steel wire with the cross members 18 being welded to the members 16 and 30. As discussed previously, the spacing of the cross members 18 is predicated upon the design requirements of the spacing between the dowels 26 and the support requirements. The gauge of the wire will be determined by those skilled in the art on the basis of the amount of support required to hold the dowels 26 parallel to the subgrade at the height C when concrete is poured over the support apparatus 10. If the spacing between dowels is so great that there is insufficient support provided, additional cross members may be used or the gauge of the wire may be increased. It is preferable that the first ends 22 of those cross members added solely for additional support do not extend outwardly beyond the member 16, so that those in the field will readily know not to attached clips 20 to these cross members.

The size of the support apparatus 10 for the load transfer dowels is dependent upon the need of a particular concrete construction. The engineer can select standard units, particularly for highway construction, or may have the apparatus 10 custom designed by those skilled in the art. For example, in a preferred embodiment, to support a dowel having a 1 inch diameter, the sleeve 46 has an interior diameter of 1.08 inches and an interior longitudinal length of 2.5 inches. The cavity has sufficient space to receive the first end 22 of a cross member 18 that extends up to I inch beyond the member 16 and has a diameter no greater than 11/32 of an inch. The gripper is preferredly 2 and 3/8ths inches long and its arm is curved to firmly grasp the member 16 which is approximately 11/32nds of an inch in diameter. Load transfer dowel supports 10 manufactured to the above dimensions are capable of supporting dowels having various lengths and diameters, as long as the diameter of the sleeves are compatible. These dimensions are but those of one preferred embodiment, as these dimensions may be significantly modified without jeopardizing the effectiveness of the apparatus 10.

Having thus set forth a preferred construction for the current invention, is to the remembered that this is but the preferred embodiment. Attention is now invited to a description of the use of the apparatus 10 for support of load transfer dowels 26.

The construction engineer will determine the spacing, the size of dowels 26 and the height at which the dowels must be placed above the subgrade 28 for a particular construction project based upon the customers specification. FIG. 8 is an example of dowels placed across the most prevalent construction joint, a transverse contraction joint 62 in highway construction, which are necessary to compensate for the shrinkage that occurs in freshly poured concrete. The support apparatus 10 may be used in other concrete paving joints, including but not limited to, transverse and longitudinal contraction joints, transverse and longitudinal construction joints and longitudinal expansion joints. Construction joints also separate the adjoining slabs, or other concrete blocks, to provide space for contraction and expansion of the concrete as a result of temperature changes. The primary purpose for placing dowels across construction joints is to prevent adjacent slabs, or adjacent concrete blocks from moving in relation to one another and becoming misaligned. The dowels have a smooth surface so that they do not bond to the concrete and/or a bond breaker is applied to the dowels to prevent bonding to the concrete.

The support apparatus 10 is manufactured, usually with the clips being molded at one plant and the supports being fabricated at another plant. The supports 12 and 14 being generally flat and the clips being relatively small, they may be shipped to the construction site in very compact shipments, cutting shipping costs. The dowels may then be purchased at a location close to the site, again cutting shipping costs. If the dowels were welded to the supports 12 and 14 prior to shipping, the fabricating cost would be much higher and the shipping cost will also be significantly higher. The pre-fabricated units would be much more difficult to unload and handle at the job site.

Placement of the support apparatus 10 at the job site is a very simple process. A first support 12 and a second support 14 are placed on opposing sides of each paving joint 62 which has been located on the subgrade. The clips 20 are attached to the second end 22 of each cross member 18 in which the second and 22 extends outwardly beyond the member 16. This is readily obvious to the worker in the field. The clips 20 are mounted so that the second end 22 of the cross member 18 enters the opening 36 in the body 32 and thus enters the cavity 34. The clip is pushed downwardly so that the gripper snaps around the member 16, signaling the worker that the clip has been firmly attached to the support 12 or the support 14. Once all the clips are properly mounted, all that is necessary is to insert the dowels 26 into the cylindrical sleeves 46 until the ends of the dowels meets the resistance of a ridge 52. The dowels 26 are sufficiently frictionally held within the sleeves 46 so the support apparatus 10, with the dowels in place, may be moved to the exact location desired on the subgrade. After the concrete is poured and hardened, if the dowels expand they will crush the ridges 52 and expand into the space adjacent the closed end 48 of the sleeves 46 kept open by the ridges 52 during installation.

While the foregoing describes a particularly preferred embodiment of the present invention, it is to be understood that numerous variations and modifications of the structure will occur to those skilled in the art. Accordingly, the foregoing description is to be considered illustrative only of the principles of this invention and is not to be considered limitative thereof, the scope of the invention being determined solely by the claims appended hereto.

Now that the invention has been described,

What is claimed is:

1. A support apparatus for placement of a load transfer dowel in concrete constructions comprising:

a first and a second support, each support comprising;

a longitudinal member, two cross members, said two cross members each having a first end and a second end, said first ends of said two cross members being spaced apart from one another and each of said two cross members being attached to said longitudinal member proximal said first ends of said two cross members, such that said first end of at least one of said two cross members extends outwardly a predetermined distance from said longitudinal member; and at least one clip being attached to said longitudinal member, said clip comprising;

a body having a cavity therein and an opening into said cavity, said opening and said cavity being sized and configured to receive said first end of one of said two cross members, the other cross member of said two cross members being spaced apart from said clip;

a gripper connected to said body such that said gripper grasps said longitudinal member; and a cylindrical sleeve having a first end and a second end, at least one of said ends being open, said sleeve being sized and configured to receive a dowel therein through said open-end, said sleeve being connected to said body; whereby, when said first and second supports are spaced apart a predetermined distance from one another, and a sleeve mounted on said first support is aligned with a sleeve mounted on said second support, the one end of a dowel is receivable in said sleeve of said first support and the other end of the dowel is receivable in said sleeve of said second support.

2. A support apparatus as in claim 1, wherein said body of said clip further comprises a U-shaped element, said U-shaped element having a first end and a second end, said first end being attached to said body adjacent said opening in said body and said second end of said U-shaped element extending outwardly therefrom such that when said first end of said cross member is inserted through said opening and into said cavity, said gripper grasps said member, and a portion of said cross member is received by said U-shaped element.

3. A support apparatus as in claim 2, wherein said second end of said U-shaped element of said body extends outwardly beyond said gripper.

4. A support apparatus as in claim 1, wherein said gripper comprises a resilient curved arm that extends outwardly from said body such that said member is captured between said arm and said body.

5. A support apparatus as in claim 1, wherein each said support comprises a pair of longitudinal members extending longitudinally generally parallel to one another, each said member of said pair of members being attached to said cross members.

6. A support apparatus as in claim 1, wherein said first and second supports each comprise a plurality of clips, whereby a plurality of dowels are supportable therebetween.

* * * * *